US010731451B2

(12) United States Patent
Mei et al.

(10) Patent No.: US 10,731,451 B2
(45) Date of Patent: Aug. 4, 2020

(54) EXPLOITATION METHOD AND EXPLOITATION WELL PATTERN FOR COALBED METHANE IN LOW-PERMEABILITY COALBED

(71) Applicant: PetroChina Company Limited, Beijing (CN)

(72) Inventors: Yonggui Mei, Beijing (CN); Quanjiang Zhang, Beijing (CN); Biyun Zhu, Beijing (CN); Xianzhi Wang, Beijing (CN); Jian Guo, Beijing (CN); Wuchang Zhang, Beijing (CN); Xiaohua Lian, Beijing (CN); Shengfa Mao, Beijing (CN); Zhanxin Xue, Beijing (CN); Liuping Deng, Beijing (CN)

(73) Assignee: PetroChina Company Limited, Beijing (CN)

( * ) Notice: Subject to any disclaimer, the term of this patent is extended or adjusted under 35 U.S.C. 154(b) by 0 days.

(21) Appl. No.: 16/284,594

(22) Filed: Feb. 25, 2019

(65) Prior Publication Data

US 2019/0186252 A1 Jun. 20, 2019

Related U.S. Application Data

(63) Continuation of application No. PCT/CN2018/094760, filed on Jul. 6, 2018.

(51) Int. Cl.
*E21B 43/30* (2006.01)
*E21B 43/00* (2006.01)
(Continued)

(52) U.S. Cl.
CPC ..... *E21B 43/305* (2013.01); *E21B 43/006* (2013.01); *E21B 43/26* (2013.01);
(Continued)

(58) Field of Classification Search
CPC ..... E21B 43/006; E21B 43/26; E21B 43/30; E21B 49/008; E21B 43/305; E21B 47/06
See application file for complete search history.

(56) References Cited

U.S. PATENT DOCUMENTS

2015/0247385 A1 9/2015 Chen et al.

FOREIGN PATENT DOCUMENTS

CN 103256025 A 8/2013
CN 104196453 A 12/2014
(Continued)

OTHER PUBLICATIONS

International Search Report for Int'l Application No. PCT/CN2018/094760, titled: Exploitation Method and Exploitation Well Pattern for Coalbed Methane in Low-Permeability Coalbed, dated: Sep. 28, 2018, 3 pages total.

*Primary Examiner* — Zakiya W Bates
(74) *Attorney, Agent, or Firm* — Hamilton, Brook, Smith & Reynolds, P.C.

(57) ABSTRACT

An exploitation method and an exploitation well pattern for coalbed methane in a low-permeability coalbed. The method comprises: determining a maximum principal stress direction in a low-permeability coalbed; disposing at least two large-roadway horizontal wells in the low-permeability coalbed; disposing a plurality of production wells on two sides of a horizontal segment of each of the at least two large-roadway horizontal wells, wherein a diameter of each of the production wells is smaller than a diameter of the horizontal segment; exploiting the coalbed methane in the low-permeability coalbed through the at least two large-roadway horizontal wells and the plurality of production wells. Through the horizontal segments of the large-roadway horizontal wells perpendicular to the maximum principal stress direction, it promotes stress release in low-permeability coalbed
(Continued)

to form more fracture channels, thereby improving the exploitation efficiency of the coalbed methane in the low-permeability coalbed.

24 Claims, 4 Drawing Sheets

(51) Int. Cl.

| | |
|---|---|
| ***E21B 49/00*** | (2006.01) |
| ***E21B 43/26*** | (2006.01) |
| *E21B 21/00* | (2006.01) |
| *E21B 7/04* | (2006.01) |

(52) U.S. Cl.
CPC ..... *E21B 43/30* (2013.01); *E21B 7/046* (2013.01); *E21B 21/00* (2013.01); *E21B 49/00* (2013.01)

(56) References Cited

FOREIGN PATENT DOCUMENTS

| | | | |
|---|---|---|---|
| CN | 106978998 | A | 7/2017 |
| CN | 107044275 | A | 8/2017 |

EXPLOITATION METHOD AND EXPLOITATION WELL PATTERN FOR COALBED METHANE IN LOW-PERMEABILITY COALBED

RELATED APPLICATION(S)

This application is a continuation of International Application No. PCT/CN2018/094760, which designated the United States and was filed on Jul. 6, 2018, published in Chinese which claims priority under 35 U.S.C. § 119 or 365 to China, Application No. 201710894345.X, filed on Sep. 28, 2017.

The entire teachings of the above applications are incorporated herein by reference.

TECHNICAL FIELD

The present disclosure relates to the field of coalbed methane exploitation, and particularly to an exploitation method and an exploitation well pattern for coalbed methane in a low-permeability coalbed.

BACKGROUND ART

Since the coalbed methane is mainly adsorbed in pores of a coalbed in an adsorption state, during an exploitation of the coalbed methane, a pressure of the coalbed is mainly reduced by extracting water in the coalbed. When the pressure drops to a certain extent, gases adsorbed in the coalbed are resolved and converted into free gases. Next, the free gases are diffused into a coalbed methane well through fractures in the coalbed to realize the exploitation of the coalbed methane. However, some coalbeds have low permeabilities, i.e., they are low-permeability coalbeds, it is difficult for the free gases to be diffused into the coalbed methane well, resulting in a low exploitation efficiency of the coalbed methane in the low-permeability coalbeds. Thus, an exploitation method for coalbed methane in a low-permeability coalbed is urgently needed.

In the related arts, in low-permeability coalbeds around a coalbed methane well, caves are constructed by means of deviated directional drilling to form a coalbed stress concentration area. During coalbed stress equalization, the coalbed stress in the low-permeability coalbed is released, while the low-permeability coalbed undergoes tensile and shear failures, thereby generating new fractures, and forming gas diffusion channels through which the free gases flow into the coalbed methane well to achieve an efficient exploitation of the coalbed methane.

However, the release space for the coalbed stress in the low-permeability coalbed is limited after the transformation of the low-permeability coalbed by constructing the caves by means of deviated directional drilling, the diffusion channels formed in the low-permeability coalbed are not obvious, and the exploitation efficiency of the coalbed methane is not significantly improved.

SUMMARY OF THE DISCLOSURE

In order to solve the problem of the low exploitation efficiency of the coalbed methane in the low-permeability coalbed in the related arts, the embodiments of the present disclosure provide an exploitation method and an exploitation well pattern for coalbed methane in a low-permeability coalbed. The technical solutions are as follows:

In one aspect, there is provided an exploitation method for coalbed methane in a low-permeability coalbed, comprising:

determining a maximum principal stress direction in the low-permeability coalbed, wherein the low-permeability coalbed refers to a coalbed having a permeability lower than a preset permeability;

disposing at least two large-roadway horizontal wells in the low-permeability coalbed, wherein each of the large-roadway horizontal wells comprises a vertical segment and a horizontal segment, the horizontal segment is perpendicular to the maximum principal stress direction, and a distance between the horizontal segments of every two adjacent large-roadway horizontal wells in the maximum principal stress direction is within a first preset distance range, and wherein the large-roadway horizontal well refers to a well having a diameter of a horizontal segment within a preset diameter range;

disposing a plurality of production wells on two sides of the horizontal segment of each of the at least two large-roadway horizontal wells, wherein a diameter of each of the production wells is smaller than the diameter of the horizontal segment of the large-roadway horizontal well;

exploiting the coalbed methane in the low-permeability coalbed through the at least two large-roadway horizontal wells and the plurality of production wells.

In another aspect, there is provided an exploitation well pattern for coalbed methane in a low-permeability coalbed, comprising:

at least two large-roadway horizontal wells each comprising a vertical segment and a horizontal segment, wherein the horizontal segment is perpendicular to a maximum principal stress direction in the low-permeability coalbed, and a distance between the horizontal segments of every two adjacent large-roadway horizontal wells in the maximum principal stress direction is within a first preset distance range;

a plurality of production wells disposed on two sides of the horizontal segment of each of the at least two large-roadway horizontal wells.

The beneficial effects brought by the technical solutions provided by the embodiments of the present disclosure are as follows: in the embodiments of the present disclosure, after the maximum principal stress direction in the low-permeability coalbed is determined, at least two large-roadway horizontal wells are disposed in the low-permeability coalbed to ensure that the horizontal segment of each of the large-roadway horizontal wells is perpendicular to the maximum principal stress direction. A distance between the horizontal segments of every two adjacent large-roadway horizontal wells in the maximum principal stress direction is within a first preset distance range, so as to improve the stress release effect in each direction in the low-permeability coalbed, thereby forming more fracture channels in the low-permeability coalbed during the stress release in each direction. Meanwhile, a plurality of production wells are disposed on two sides of the horizontal segment of each of the large-roadway horizontal wells, so as to exploit the coalbed methane in the low-permeability coalbed through the at least two large-roadway horizontal wells and the plurality of production wells at the same time, thereby improving the exploitation efficiency of the coalbed methane.

BRIEF DESCRIPTION OF THE DRAWINGS

In order to more clearly describe the technical solutions in the embodiments of the present disclosure, the drawings to be used in the description of the embodiments will be briefly introduced as follows. Obviously, the drawings in the following description just illustrate some embodiments of the present disclosure, and a person skilled in the art can obtain other drawings from them without paying any creative effort.

DETAILED DESCRIPTION OF THE PREFERRED EMBODIMENTS

In order that the objective, the technical solutions and the advantages of the embodiments of the present disclosure are clearer, the embodiments of the present disclosure will be further described in detail as follows with reference to the drawings.

Figure 1:
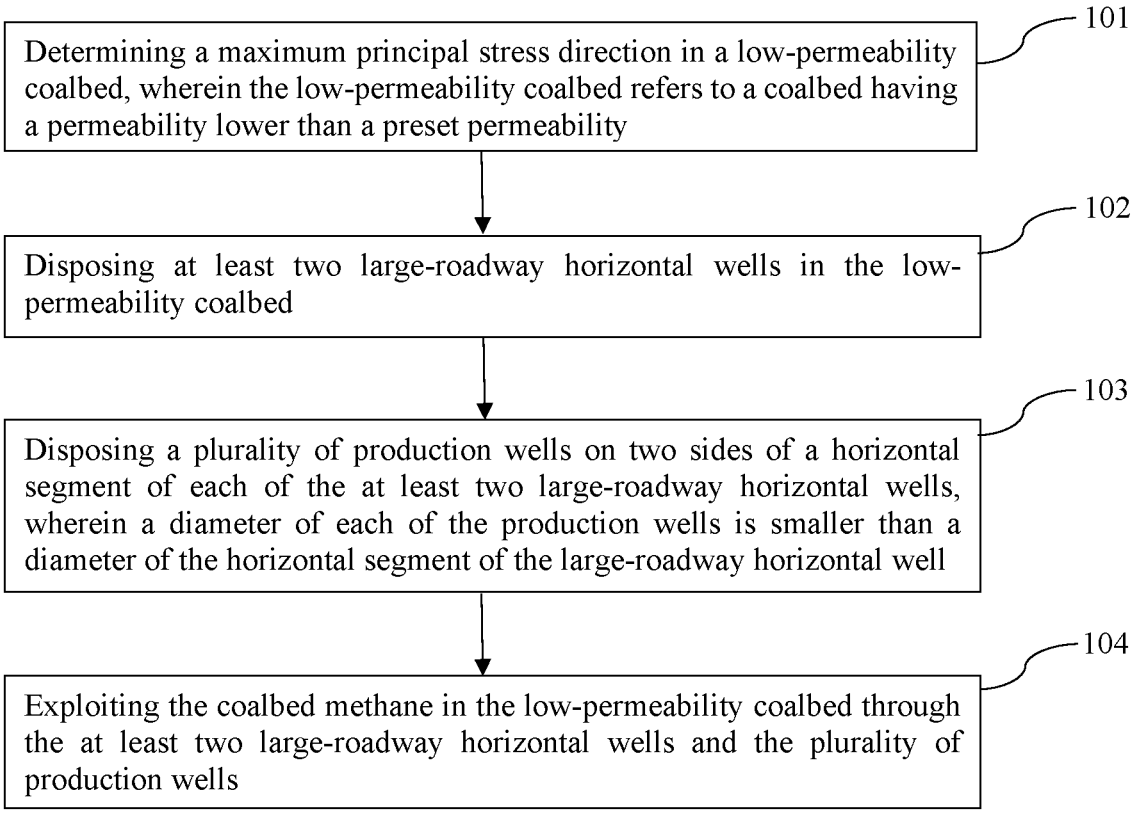
FIG. 1 is a flowchart of an exploitation method for coalbed methane in a low-permeability coalbed provided by an embodiment of the present disclosure.

FIG. 1 is a flowchart of an exploitation method for coalbed methane in a low-permeability coalbed provided by an embodiment of the present disclosure. Referring to FIG. 1, the method comprises the following steps.

Step 101: determining a maximum principal stress direction in a low-permeability coalbed, wherein the low-permeability coalbed refers to a coalbed having a permeability lower than a preset permeability.

Step 102: disposing at least two large-roadway horizontal wells in the low-permeability coalbed, wherein each of the large-roadway horizontal wells comprises a vertical segment and a horizontal segment, the horizontal segment is perpendicular to the maximum principal stress direction, and a distance between the horizontal segments of every two adjacent large-roadway horizontal wells in the maximum principal stress direction is within a first preset distance range, and wherein the large-roadway horizontal well refers to a well having a diameter of a horizontal segment within a preset diameter range.

Step 103: disposing a plurality of production wells on two sides of the horizontal segment of each of the at least two large-roadway horizontal wells, wherein a diameter of each of the production wells is smaller than the diameter of the horizontal segment of the large-roadway horizontal well.

Step 104: exploiting the coalbed methane in the low-permeability coalbed through the at least two large-roadway horizontal wells and the plurality of production wells.

In the embodiments of the present disclosure, after the maximum principal stress direction in the low-permeability coalbed is determined, at least two large-roadway horizontal wells are disposed in the low-permeability coalbed to ensure that the horizontal segment of each of the large-roadway horizontal wells is perpendicular to the maximum principal stress direction. In addition, a distance between the horizontal segments of every two adjacent large-roadway horizontal wells in the maximum principal stress direction is within a first preset distance range, so as to improve the stress release effect in each direction in the low-permeability coalbed, thereby forming more fracture channels in the low-permeability coalbed during the stress release in each direction. A plurality of production wells are disposed on two sides of the horizontal segment of each of the large-roadway horizontal wells, so as to exploit the coalbed methane in the low-permeability coalbed through the at least two large-roadway horizontal wells and the plurality of production wells at the same time, thereby improving the exploitation efficiency of the coalbed methane.

Optionally, disposing at least two large-roadway horizontal wells in the low-permeability coalbed comprises:

disposing at least two horizontal wells in the low-permeability coalbed through a wall reinforcing technology and a geosteering technology, wherein each of the horizontal wells comprises a vertical segment and a horizontal segment;

reaming the horizontal segments of the at least two horizontal wells by a high-pressure hydraulic injection method to obtain the at least two large-roadway horizontal wells.

Optionally, exploiting the coalbed methane in the low-permeability coalbed through the at least two large-roadway horizontal wells and the plurality of production wells comprises:

pumping in the at least two large-roadway horizontal wells, respectively, so as to exploit the coalbed methane through the at least two large-roadway horizontal wells;

fracturing the low-permeability coalbed through which each of the plurality of production wells passes, and after the fracturing, pumping in the plurality of production wells, respectively, so as to exploit the coalbed methane through the plurality of production wells.

Optionally, the at least two large-roadway horizontal wells can form a plurality of large-roadway horizontal well strings each comprising at least one large-roadway horizontal well, the horizontal segments comprised in the at least one large-roadway horizontal wells are located in a same coalbed, and a distance between the horizontal segments of every two adjacent large-roadway horizontal well strings in the maximum principal stress direction is within the first preset distance range.

Optionally, each of the horizontal segments comprised in the at least two large-roadway horizontal wells has a length greater than a preset length.

Optionally, the preset length is 600 meters.

Optionally, an inter-well distance between any two production wells disposed on a same side of the horizontal segment of each of the large-roadway horizontal wells is within a second preset distance range.

Optionally, the preset permeability is 0.01 millidarcy, the first preset distance range refers to a distance range greater than or equal to 2 kilometers and less than or equal to 4 kilometers, and the preset diameter range refers to a diameter range greater than or equal to 1 meter and less than or equal to 2 meters.

Optionally, each of the at least two large-roadway horizontal wells is L-shaped.

The above optional technical solutions may be combined arbitrarily to form the optional embodiments of the present disclosure, which are not described one by one herein.

Figure 2A:
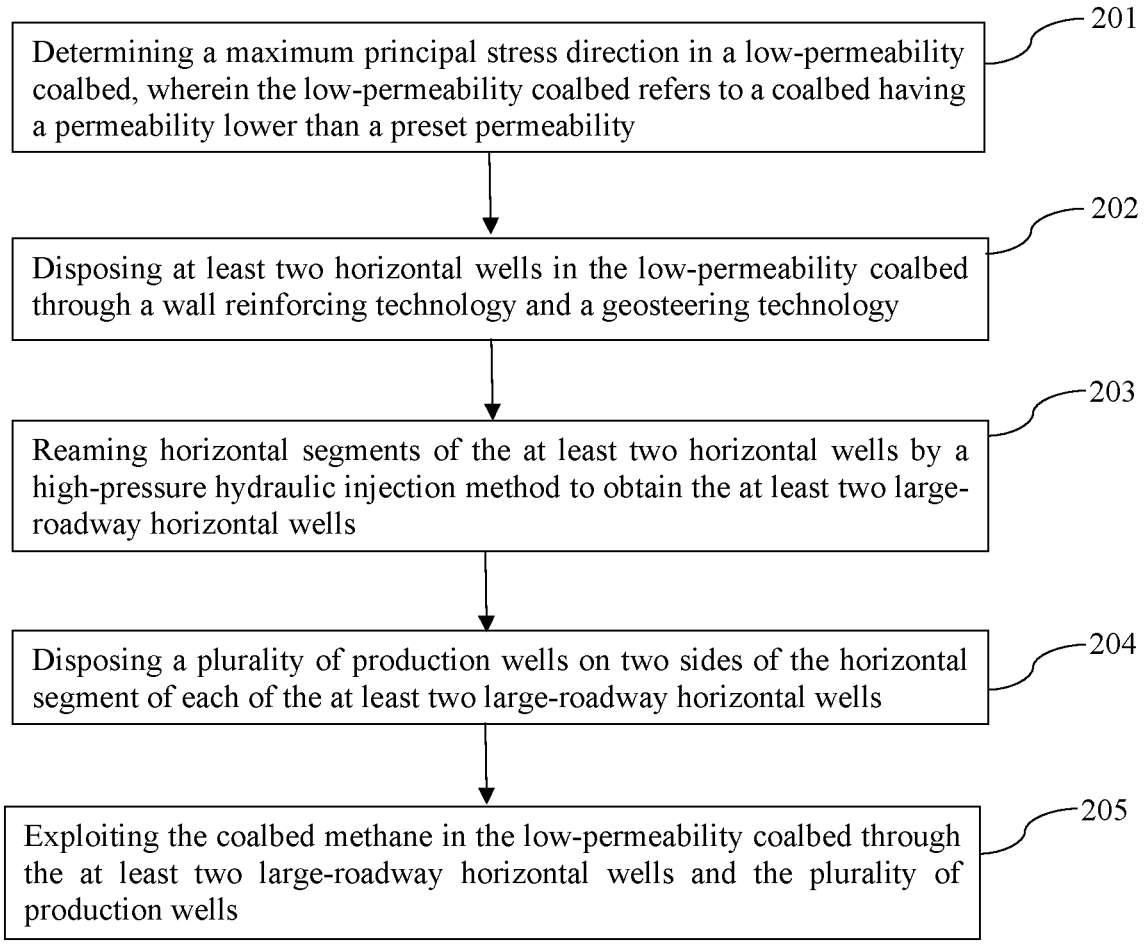
FIG. 2A is a flowchart of another exploitation method for coalbed methane in a low-permeability coalbed provided by an embodiment of the present disclosure.

FIG. 2A is a flowchart of another exploitation method for coalbed methane in a low-permeability coalbed 1 (FIG. 2B) provided by an embodiment of the present disclosure. Referring to FIG. 2A, the method comprises the following steps.

Step 201: determining a maximum principal stress direction in a low-permeability coalbed 1, wherein the low-permeability coalbed 1 refers to a coalbed having a permeability lower than a preset permeability.

In which, the preset permeability may be 0.008 millidarcy, 0.010 millidarcy or 0.012 millidarcy, and preferably, the preset permeability is 0.010 millidarcy.

Due to the effect on the low-permeability coalbed 1 by the stress in each direction in the low-permeability coalbed 1 in a formation, fracture channels generated by the low-permeability coalbed 1 are small, thereby reducing the exploitation efficiency of the coalbed methane in the low-permeability coalbed 1. Therefore, in order to improve the exploitation efficiency of the coalbed methane in the low-permeability coalbed 1, it is possible to provide a release space for the stress in each direction in the low-permeability coalbed 1, thereby causing more fracture channels to be formed in the low-permeability coalbed 1 during the stress release in each direction. During the stress release in each direction in the low-permeability coalbed 1, in order to improve the release efficiency of the stress in each direction and the release effect, a release space may be provided in a direction perpendicular to a maximum principal stress direction F in the low-permeability coalbed 1. Thus, it is possible to determine, in advance, a direction of a maximum stress among the stresses in all the directions in the low-permeability coalbed 1, i.e., the maximum principal stress direction F in the low-permeability coalbed 1.

When the maximum principal stress direction F in the low-permeability coalbed 1 is to be determined, an ellipticity of a wellbore may be measured by a gyroscope, and then a long axis direction of the ellipse is determined as the maximum principal stress direction. Of course, the maximum principal stress direction F in the low-permeability coalbed 1 may also be determined in other methods. For example, it is possible to monitor an extension direction of the fracture in the low-permeability coalbed 1 based on the seismic fractures, and determine the direction as the maximum principal stress direction F.

Further, before the maximum principal stress direction F in the low-permeability coalbed 1 is determined, it is also possible to select a low-permeability coalbed 1 of a relatively gentle construction based on the geological data of each coalbed. For example, it is also possible to select a coalbed of a relatively gentle construction based on plane spacing between the contour lines in the coalbed topography, wherein the contour lines are arranged more sparsely as the plane spacing between the contour lines increases, which means that as the construction of the coalbed is gentler, the spacing between the contour lines decreases and the contour lines are arranged more densely, thereby indicating that the coalbed is steeper. Of course, it is also possible to select a coalbed of a relatively gentle construction based on the seismic section maps of the coalbeds, wherein when a seismic section map has a formation dip less than or equal to 5 degrees, the coalbed is determined as having a relatively gentle construction.

After the maximum principal stress direction F in the low-permeability coalbed 1 is determined, the release space for the stress in each direction may be set in the low-permeability coalbed 1 based on the maximum principal stress direction F, i.e., through steps 202 to 203, at least two large-roadway horizontal wells are disposed in the low-permeability coalbed 1 to facilitate the stress release in each direction in the low-permeability coalbed 1.

Step 202: disposing at least two horizontal wells in the low-permeability coalbed 1 through a wall reinforcing technology and a geosteering technology, wherein each of the horizontal wells comprises a vertical segment and a horizontal segment.

At least two horizontal wells are disposed in the low-permeability coalbed 1, and each of the horizontal wells is L-shaped, i.e., each of the horizontal wells may comprise a vertical segment and a horizontal segment. In the process of disposing the at least two horizontal wells, since the soft area of the low-permeability coalbed 1 is prone to a collapse and the drill bit of the drilling equipment is easy to deviate from the coalbed, the wall reinforcing technology may be adopted to reinforce the well wall of the horizontal segment of each of the horizontal wells, so as to avoid the collapse of the soft area. In addition, the geosteering technology may be adopted to monitor the drilling direction of the drill bit in real time, and adjust the drilling direction of the drill bit in time when the drilling direction of the drill bit deviates from the low-permeability coalbed 1, so as to ensure that the horizontal segment of each of the horizontal wells is within the low-permeability coalbed.

Regarding the wall reinforcing technology, in a possible implementation, viscous liquid, such as temperature resistant glue, may be added to the drilling fluid, and it is ensured that the viscous liquid invades into the low-permeability coalbed 1 in the process of disposing each of the horizontal wells, thereby achieving the purpose of reinforcing the well wall of the horizontal segment of each of the horizontal wells. Of course, the reinforcement of the well wall may also be achieved in other ways, which are not limited herein.

Regarding the geosteering technology, in a possible implementation, an onboard guiding instrument may be mounted near the drill bit, and the drilling direction of the drill bit may be monitored in real time based on the onboard guiding instrument. Of course, the drilling direction of the drill bit may also be monitored in other ways, which are not limited herein.

Step 203: reaming the horizontal segments of the at least two horizontal wells by a high-pressure hydraulic injection method to obtain the at least two large-roadway horizontal wells 3.

Figure 2B:
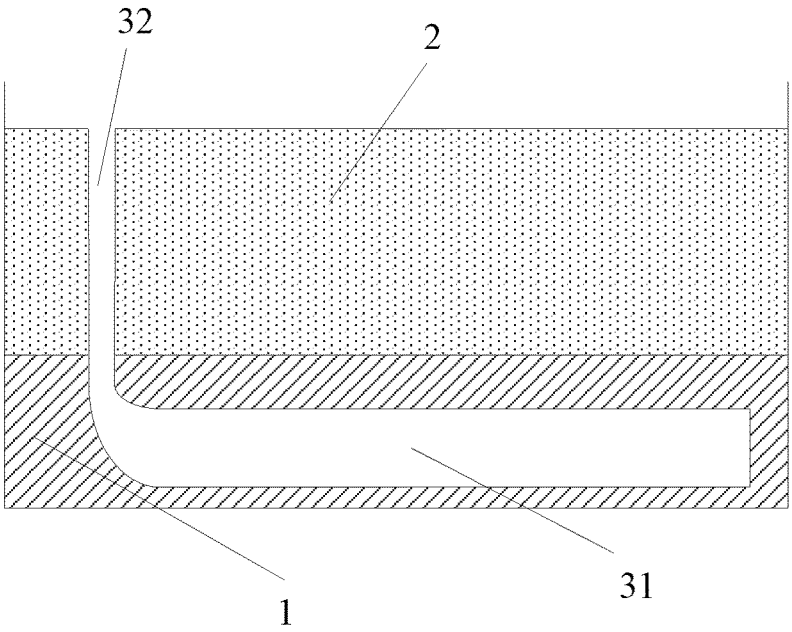
FIG. 2B is a schematic front view of a structure of a large-roadway horizontal well provided by an embodiment of the present disclosure.

After the at least two horizontal wells are disposed in the low-permeability coalbed 1, in order to improve the release effect of the stress in each direction, the horizontal segment of each of the horizontal wells may be reamed by a high-pressure hydraulic injection method. Of course, the horizontal segment of each of the horizontal wells may also be reamed by other methods to obtain the at least two large-roadway horizontal wells 3. As shown in FIG. 2B, since a cover layer 2 is located on the low-permeability coalbed 1, when the large-roadway horizontal well 3 passes through the cover layer 2, in order to facilitate the stress release in each direction in the low-permeability coalbed 1, the horizontal segment 31 of the large-roadway horizontal well 3 is located in the low-permeability coalbed 1, i.e., each of the at least two large-roadway horizontal wells 3 is L-shaped.

The high-pressure hydraulic injection method refers to a method of reaming a horizontal segment of a horizontal well by a high-pressure impact of gravels carried in a liquid after pressurizing the liquid. The large-roadway horizontal well 3 refers to a well in which a diameter of a horizontal segment 31 is within a preset diameter range. When the diameter of the horizontal segment 31 is small, the stress release in each direction is inconvenient, and when the diameter of the horizontal segment 31 is large, the technical requirement is improved and the exploitation cost of the coalbed methane is increased. Therefore, preferably the preset diameter range refers to a diameter range greater than or equal to 1 meter and less than or equal to 2 meters.

As shown in FIG. 2B, each of the large-roadway horizontal wells 3 may comprise a vertical segment 32 and a horizontal segment 31; the horizontal segment 31 may be perpendicular to the maximum principal stress direction F, and a length of each of the horizontal segments 31 comprised in the at least two large-roadway horizontal wells 3 is greater than a preset length; wherein the preset length may be 400 meters, 500 meters or 600 meters, etc.; and in order to increase the release range of the stress in each direction in the low-permeability coalbed 1, preferably the preset length is 600 meters.

Figure 2C:
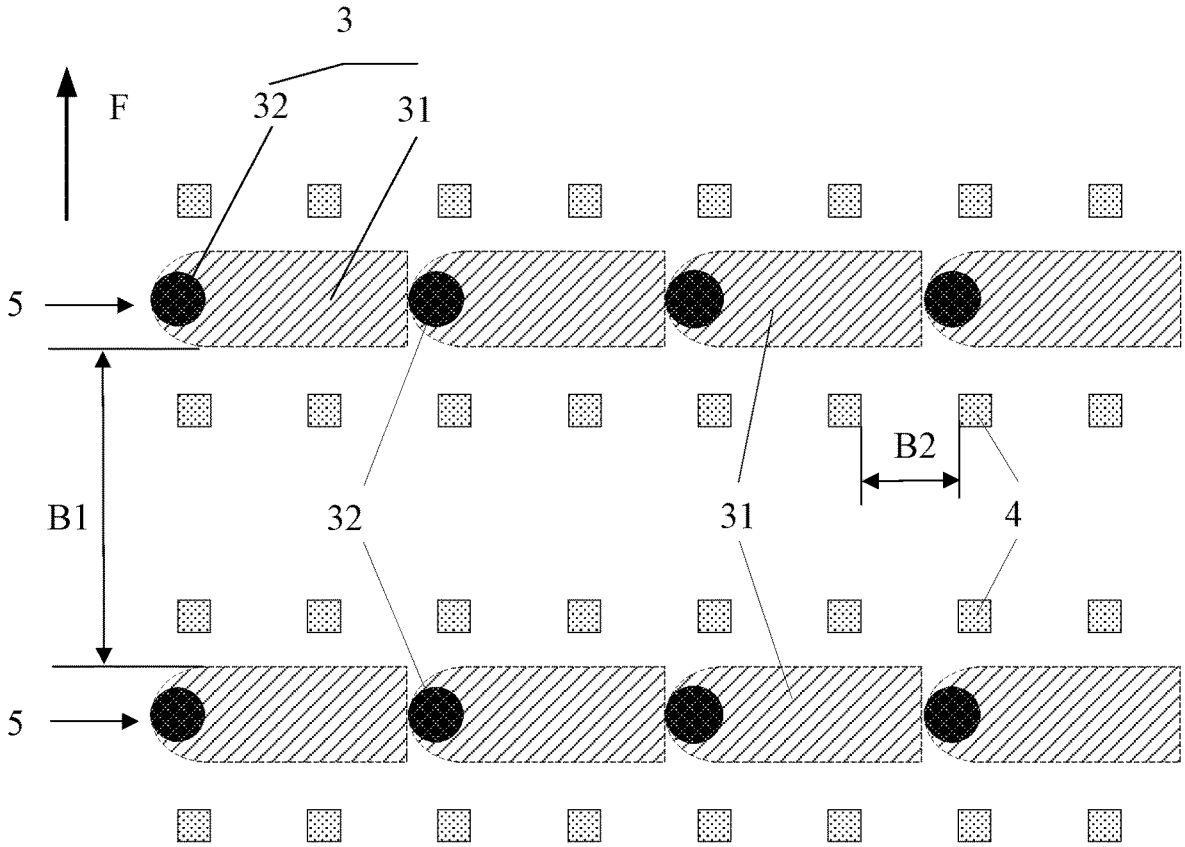
FIG. 2C is a schematic top view of structures of at least two large-roadway horizontal wells provided by an embodiment of the present disclosure.

In the low-permeability coalbed 1, in order that the stress in each direction is effectively released in the maximum principal stress direction F, as shown in FIG. 2C, in the maximum principal stress direction F, a distance between the horizontal segments 31 of every two adjacent large-roadway horizontal wells 3 is within a first preset distance B1 range. Meanwhile, in order to extend the stress release range of the low-permeability coalbed 1, as shown in FIG. 2C, the at least two large-roadway horizontal wells 3 can form a plurality of large horizontal roadway horizontal well strings 5 each comprising at least one large-roadway horizontal well 3, and horizontal segments 31 comprised in the at least one large-roadway horizontal well 3 may be located in a same coalbed. In addition, a distance between the horizontal segments of every two adjacent large-roadway horizontal well string 5 in the maximum principal stress direction F is within the first preset distance B1 range.

In order to ensure the uniform stress release in each direction in the low-permeability coalbed 1, as shown in FIG. 2C, the horizontal segments of the plurality of large-roadway horizontal well string 5 are arranged in parallel in a direction perpendicular to the maximum principal stress direction F. The first preset distance B1 range may refer to a distance range greater than or equal to 1 kilometer and less than or equal to 6 kilometers; preferably, in order to facilitate the stress release in each direction in the low-permeability coalbed 1 and reduce the exploitation cost of the coalbed methane, the first preset distance B1 range may be a distance range greater than or equal to 2 kilometers and less than or equal to 4 kilometers.

Figure 2D:
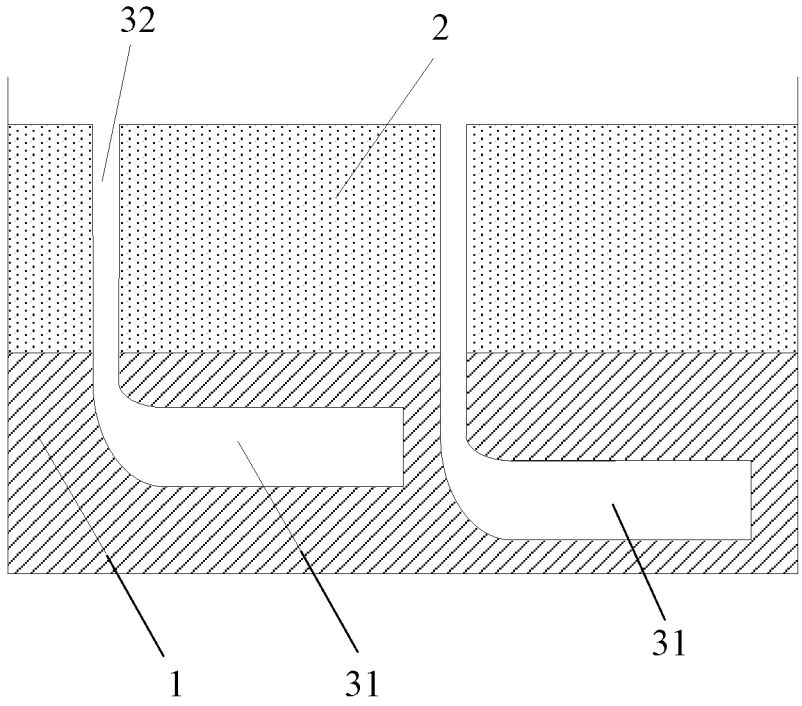
FIG. 2D is a schematic front view of structures of at least two large-roadway horizontal wells provided by an embodiment of the present disclosure.

It should be noted that since the low-permeability coalbed 1 may have a certain thickness, when the large-roadway horizontal wells 3 are disposed, the horizontal segments 31 of each of the large-roadway horizontal wells 3 may have a different depth, i.e., as shown in FIG. 2D, the horizontal segments 31 of all the large-roadway horizontal wells are strewn at random to form a stereoscopic impression, and ensure the stress release in each direction in the entire area of the low-permeability coalbed 1.

Step 204: disposing a plurality of production wells 4 on two sides of the horizontal segment 31 of each of the at least two large-roadway horizontal wells 3.

Since a distance between the horizontal segments 31 of every two adjacent large-roadway production wells 3 in the maximum principal stress direction F is within the first preset distance B1 range, in order for the exploitation of the coalbed methane in the low-permeability coalbed 1 within the first preset distance B1 range so as to improve exploitation efficiency and shorten the exploitation cycle, a plurality of production wells 4 may be disposed at the two sides of the horizontal segment 31 of each of the large-roadway horizontal wells 3.

A diameter of each of the production wells 4 is smaller than a diameter of the horizontal segment 31 of the large-roadway horizontal well 3, and each of the production wells 4 may be a vertical well, an inclined well or a horizontal well.

An inter-well distance between any two production wells 4 disposed on a same side of the horizontal segment 31 of each of the large-roadway horizontal wells 3 is within a second preset distance B2 range, and the second preset distance B2 range may be greater than or equal to 100 meters and less than or equal to 600 meters; preferably, in order to avoid any two production wells 4 interacting with each other during the exploitation of the coalbed methane and shorten the exploitation cycle of the coalbed methane, the second preset distance B2 range is greater than or equal to 200 meters and less than or equal to 400 meters.

Step 205: exploiting the coalbed methane in the low-permeability coalbed 1 through the at least two large-roadway horizontal wells 3 and the plurality of production wells 4;

pumping in the at least two large-roadway horizontal wells 3, respectively, so as to exploit the coalbed methane through the at least two large-roadway horizontal wells 3; fracturing the low-permeability coalbed 1 through which each of the plurality of production wells 4 passes, and after the fracturing, pumping in the plurality of production wells 4, respectively, so as to exploit the coalbed methane through the plurality of production wells 4.

In the embodiments of the present disclosure, after the maximum principal stress direction F in the low-permeability coalbed 1 is determined, at least two horizontal wells are disposed in the low-permeability coalbed 1, and at least two large-roadway horizontal wells 3 are obtained by reaming the horizontal segment of each of the horizontal wells. In addition, the horizontal segment 31 in each of the large-roadway horizontal wells 3 is perpendicular to the maximum principal stress direction F, and a distance between the horizontal segments 31 in every two adjacent large-roadway horizontal wells 3 in the maximum principal stress direction F is within the first preset distance B1 range, so as to improve the stress release effect in each direction in the low-permeability coalbed 1, thereby forming more fracture channels in the low-permeability coalbed 1 during the stress release in each direction. A plurality of production wells 4 are disposed on two sides of the horizontal segment 31 of each of the large-roadway horizontal wells 3, so as to exploit the coalbed methane in the low-permeability coalbed 1 through the at least two large-roadway horizontal wells 3 and the plurality of production wells 4 at the same time, thereby improving the exploitation efficiency of the coalbed methane.

A person skilled in the art will appreciate that all or a part of the steps for implementing those embodiments may be completed by hardware, or by instructing relevant hardware through a program that may be stored in a computer readable storage medium such as a read-only memory, a magnetic disk or an optical disk.

Those described above are just preferred embodiments of the present disclosure, rather than limitations thereto. Any amendment, equivalent replacement, improvement, etc. made within the spirit and principle of the present disclosure should fall within the protection scope of the present disclosure.

While example embodiments have been particularly shown and described, it will be understood by those skilled in the art that various changes in form and details may be made therein without departing from the scope of the embodiments encompassed by the appended claims.

What is claimed is:

1. An exploitation method for coalbed methane in a low-permeability coalbed, comprising:

determining a maximum principal stress direction in the low-permeability coalbed, wherein the low-permeability coalbed refers to a coalbed having a permeability lower than a preset permeability;

disposing at least two large-roadway horizontal wells in the low-permeability coalbed, wherein each of the large-roadway horizontal wells comprises a vertical segment and a horizontal segment, the horizontal segment is perpendicular to the maximum principal stress direction, and a distance between the horizontal segments of every two adjacent large-roadway horizontal wells in the maximum principal stress direction is within a first preset distance range, and wherein the large-roadway horizontal well refers to a well having a diameter of a horizontal segment within a preset diameter range;

disposing a plurality of production wells on two sides of the horizontal segment of each of the at least two large-roadway horizontal wells, wherein a diameter of each of the production wells is smaller than the diameter of the horizontal segment of the large-roadway horizontal well;

exploiting the coalbed methane in the low-permeability coalbed through the at least two large-roadway horizontal wells and the plurality of production wells; and wherein the first preset distance range refers to a distance range greater than or equal to 2 kilometers and less than or equal to 4 kilometers, and the preset diameter range refers to a diameter range greater than or equal to 1 meter and less than or equal to 2 meters.

2. The method according to claim 1, wherein disposing at least two large-roadway horizontal wells in the low-permeability coalbed comprises:

disposing at least two horizontal wells in the low-permeability coalbed through a wall reinforcing technology and a geosteering technology, wherein each of the horizontal wells comprises a vertical segment and a horizontal segment; and reaming the horizontal segments of the at least two horizontal wells by a high-pressure hydraulic injection method to obtain the at least two large-roadway horizontal wells.

3. The method according to claim 2, wherein each of the horizontal segments comprised in the at least two large-roadway horizontal wells has a length greater than a preset length.

4. The method according to claim 3, wherein the preset length is 600 meters.

5. The method according to claim 2, wherein an inter-well distance between any two production wells disposed on a same side of the horizontal segment of each of the large-roadway horizontal wells is within a second preset distance range.

6. The method according to claim 1, wherein exploiting the coalbed methane in the low-permeability coalbed through the at least two large-roadway horizontal wells and the plurality of production wells comprises:

pumping in the at least two large-roadway horizontal wells, respectively, so as to exploit the coalbed methane through the at least two large-roadway horizontal wells; and fracturing the low-permeability coalbed through which each of the plurality of production wells passes, and after the fracturing, pumping in the plurality of production wells, respectively, so as to exploit the coalbed methane through the plurality of production wells.

7. The method according to claim 6, wherein each of the horizontal segments comprised in the at least two large-roadway horizontal wells has a length greater than a preset length.

8. The method according to claim 7, wherein the preset length is 600 meters.

9. The method according to claim 6, wherein an inter-well distance between any two production wells disposed on a same side of the horizontal segment of each of the large-roadway horizontal wells is within a second preset distance range.

10. The method according to claim 1, wherein the at least two large-roadway horizontal wells can form a plurality of large-roadway horizontal well strings each comprising at least one large-roadway horizontal well, the horizontal segments comprised in the at least one large-roadway horizontal wells are located in a same coalbed, and a distance between the horizontal segments of every two adjacent large-roadway horizontal well strings in the maximum principal stress direction is within the first preset distance range.

11. The method according to claim 10, wherein each of the horizontal segments comprised in the at least two large-roadway horizontal wells has a length greater than a preset length.

12. The method according to claim 11, wherein the preset length is 600 meters.

13. The method according to claim 10, wherein an inter-well distance between any two production wells disposed on a same side of the horizontal segment of each of the large-roadway horizontal wells is within a second preset distance range.

14. The method according to claim 1, wherein each of the horizontal segments comprised in the at least two large-roadway horizontal wells has a length greater than a preset length.

15. The method according to claim 14, wherein the preset length is 600 meters.

16. The method according to claim 1, wherein an inter-well distance between any two production wells disposed on a same side of the horizontal segment of each of the large-roadway horizontal wells is within a second preset distance range.

17. The method according to claim 1, wherein each of the at least two large-roadway horizontal wells is L-shaped.

18. An exploitation well pattern for coalbed methane in a low-permeability coalbed, comprising:

at least two large-roadway horizontal wells each comprising a vertical segment and a horizontal segment, wherein the horizontal segment is perpendicular to a maximum principal stress direction in the low-permeability coalbed, and a distance between the horizontal segments of every two adjacent large-roadway horizontal wells in the maximum principal stress direction is within a first preset distance range, and wherein the large-roadway horizontal well refers to a well having a diameter of a horizontal segment within a preset diameter range, the preset diameter range refers to a diameter range greater than or equal to 1 meter and less than or equal to 2 meters, and the first preset distance range refers to a distance range greater than or equal to 2 kilometers and less than or equal to 4 kilometers; and a plurality of production wells disposed on two sides of the horizontal segment of each of the at least two large-roadway horizontal wells, wherein a diameter of each of the production wells is smaller than the diameter of the horizontal segment of the large-roadway horizontal well.

19. The exploitation well pattern for the coalbed methane in the low-permeability coalbed according to claim 18, wherein each of the horizontal segments comprised in the at least two large-roadway horizontal wells has a length greater than a preset length.

20. The exploitation well pattern for the coalbed methane in the low-permeability coalbed according to claim 19, wherein the preset length is 400 meters, 500 meters or 600 meters.

21. The exploitation well pattern for the coalbed methane in the low-permeability coalbed according to claim 18, wherein the at least two large-roadway horizontal wells can form a plurality of large-roadway horizontal well strings each comprising at least one large-roadway horizontal well, the horizontal segments comprised in the at least one large-roadway horizontal wells are located in a same coalbed, and a distance between the horizontal segments of every two adjacent large-roadway horizontal well strings in the maximum principal stress direction is within the first preset distance range.

22. The exploitation well pattern for the coalbed methane in the low-permeability coalbed according to claim 18, wherein each of the production wells is a vertical well, an inclined well or a horizontal well.

23. The exploitation well pattern for the coalbed methane in the low-permeability coalbed according to claim 18, wherein an inter-well distance between any two production wells disposed on a same side of the horizontal segment of each of the large-roadway horizontal wells is within a second preset distance range, and the second preset distance range refers to a distance range greater than or equal to 100 meters and less than or equal to 600 meters.

24. The exploitation well pattern for the coalbed methane in the low-permeability coalbed according to claim 23, wherein the second preset distance range refers to a distance range greater than or equal to 200 meters and less than or equal to 400 meters.

* * * * *